United States Patent [19]

Glaeser et al.

[11] Patent Number: 4,863,069

[45] Date of Patent: Sep. 5, 1989

[54] APPLICATOR DISPENSING AND STORING OF PARTICULATE CARPET-CLEANING COMPOSITION

[76] Inventors: William F. Glaeser, 2925 S. 92nd St., Milwaukee, Wis. 53227; Grant D Hodges, 79 Ranch Dr., Ponca City, Okla. 74601; David R. Sheppard, 3807 40th St., Kenosha, Wis. 53140 Norman K. Harris, 501 Hialead Dr. Racine, Wis. 53402 Goeffrey B. Rench, 111-11th St. Racine, Wis. 53402

[21] Appl. No.: 183,108

[22] Filed: Apr. 19, 1988

Related U.S. Application Data

[63] Continuation-in-part of Ser. No. 48,641, May 11, 1987, abandoned, and a continuation-in-part of Ser. No. 48,820, May 12, 1987, abandoned.

[51] Int. Cl.[4] ..... B05C 19/00; A47L 13/00; B67D 5/64

[52] U.S. Cl. ..... 222/169; 222/171; 222/485; 222/613; 222/624; 401/48; 401/220; 403/108; 403/328; 111/74

[58] Field of Search ..... 401/48, 140, 219, 220; 222/169, 171, 519, 520, 553, 485, 486, 613, 614, 617, 624, 625; 403/328, 326, 93, 108; 111/74

[56] References Cited

U.S. PATENT DOCUMENTS

| | | | |
|---|---|---|---|
| 211,106 | 1/1879 | Norton | 222/171 |
| 991,790 | 5/1911 | Lampke | 111/74 X |
| 1,189,802 | 7/1916 | Eckert | 403/328 X |
| 1,390,383 | 9/1921 | Powell | 222/169 |
| 2,632,583 | 3/1953 | Allen | 222/169 |
| 2,832,509 | 4/1958 | Emanatian | 222/169 X |
| 2,991,914 | 7/1961 | Janssen, Jr. | 222/171 |
| 4,165,854 | 8/1979 | Duly | 403/328 X |

FOREIGN PATENT DOCUMENTS

| | | | |
|---|---|---|---|
| 12011 | 10/1913 | United Kingdom | 222/171 |

*Primary Examiner*—Richard J. Apley
*Assistant Examiner*—David J. Bender

[57] ABSTRACT

An applicator for particulate carpet-cleaning compositions having a cylindrical body formed of relatively rotatable inner and outer concentric cylindrical members in 360° frictional nested engagement, separately attached non-rotatably to opposite wheel members of greater diameter than the body, and having dispensing apertures in cylinder which may be closed by the other depending on relative rotational positions. The cylindrical members are relatively rotatable very easily be opposed manual rotation of the wheels to dispensing positions, a closed position, and a filling position in which major filling openings in the cylindrical members are aligned. The cylindrical members are indexed to exact relative positions for accurate dispensing, spill-free filling and air-tight closure.

15 Claims, 3 Drawing Sheets

FIG. 1
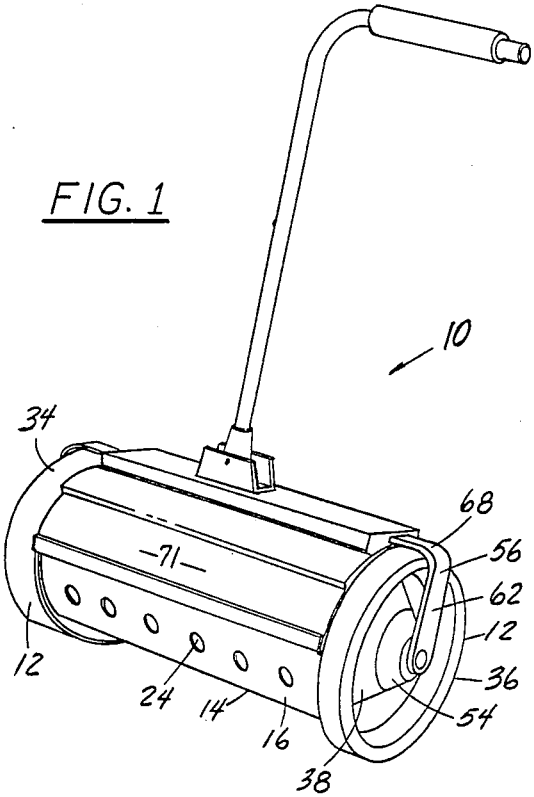
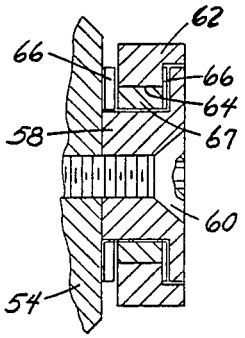
FIG. 3
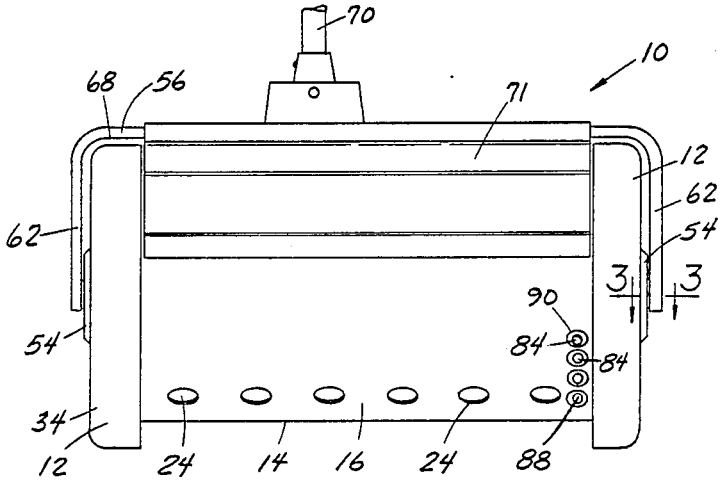
FIG. 2

APPLICATOR DISPENSING AND STORING OF PARTICULATE CARPET-CLEANING COMPOSITION

RELATED APPLICATIONS

This is a continuation-in-part of the following two earlier applications: Ser. No. 048,641, entitled CONTROLLED DISPENSING APPLICATOR FOR PARTICULATE CARPET-CLEANING COMPOSITIONS, filed May 11, 1987, now abandoned; and Ser. No. 048,820, entitled ADJUSTABLE APPLICATOR FOR DISPENSING STORING PARTICULATE CARPET-CLEANING COMPOSITIONS, filed May 12, 1987, now abandoned.

FIELD OF THE INVENTION

This invention is related generally to spreaders for particulate compositions and, more specifically, to applicators for applying particulate carpet-cleaning compositions for dry extraction carpet cleaning.

BACKGROUND OF THE INVENTION

Dry extraction carpet cleaning methods bring liquid chemical cleaning agents into contact with soiled carpet fibers by means of a particulate carpet-cleaning composition. Many tiny porous particles, partially saturated with specific liquid cleaning agents, are applied to the carpet and brushed through it in a specific manner. With this action the moist particles remove the soil from the carpet fibers and the carpet is left dry and clean after vacuum removal of the now-soiled particles.

In the application of particulates for dry extraction carpet cleaning, there are a number of specific problems and concerns. Because of this, spreading has often been accomplished by manual methods, rather than by use of wheeled applicators. There is a need for an improved applicator for use in the dry carpet-cleaning industry.

Certain liquid cleaning agents in carpet-cleaning particulate carpet-cleaning compositions are rather volatile, and if the particulate compositions are left exposed to the atmosphere for an extended period of time the volatile content is greatly reduced or lost. Once dried out, such particulate compositions are of little value in carpet-cleaning operations.

Therefore, it is important to store such particulate carpet-cleaning compositions in closed substantially vapor-tight containers. Such compositions usually come in vapor-tight bags. After removal from their original packaging and loading into an applicator for spreading onto carpets, they must then either be used or else returned to a substantially vapor-tight container. Overnight storage in an applicator between carpet cleaning jobs often will result in unacceptable loss of volatiles.

There is a need for an improved applicator for such particulate compositions which will allow extended (for example, overnight) storage of the composition in the applicator, eliminating the inconvenience of removing it from the applicator into a sealed container.

Another concern with respect to the handling of such particulate carpet-cleaning compositions relates to obtaining proper adjustment of an applicator, that is, to a selected dispensing setting or to a closed condition. Adjustment of such applicators may be difficult at best and controlling the dispensing of such particulate compositions is a specific concern of carpet-cleaning professionals.

Making an applicator substantially vapor-tight and making it easily adjustable tend to be at cross purposes. There is a need for an improved applicator for particulate carpet-cleaning compositions which is both constructed to be substantially vapor-tight when closed and yet may be easily adjusted to various dispensing positions and a closed position.

The characteristics of such particulate carpet-cleaning compositions are of great importance to how well they function. Certain highly effective compositions of this type are made up of porous particles which are of irregular sizes and irregular shapes and significant amounts of liquids. Because of these characteristics such compositions are not free flowing, but often agglomerate to some extent such that dispensing onto carpets by means of an applicator is difficult.

While there have been many different applicators for various particulate compositions, including those having wheels on either side of an apertured dispensing container which dispenses the composition upon rotation about a horizontal axis, it has been found that particulate carpet-cleaning compositions of the type described are not properly dispensed using such prior art devices.

Such carpet-cleaning compositions will flow inconsistently if at all through the typically small apertures in such apertured dispensing containers. Even with larger apertures of the type which are adjustable in size, dispensing is uncontrollable or impossible. Unacceptably erratic dispensing rates occur, particularly when the apertured dispensing container is either full or fairly close to empty. The particulate carpet-cleaning composition often "bridges" even fairly large dispensing apertures if they have sharp corners or irregular shapes.

For carpet cleaners, predictability of dispensing rates is of great importance. Even dispensing allows better cleaning and allows better cost estimates.

While applicators for particulate carpet-cleaning compositions have been developed in the past, such compositions are frequently applied by hand. That is, the operator throws handfuls of the particulate composition onto the carpet before the brushing and subsequent removal. An improved applicator would clearly be of great usefulness.

Some particulate spreaders of the prior art are rather difficult to fill. A variety of filling mechanisms are disclosed in the prior art, including some with end openings, often requiring removal of a wheel or disassembly of the container, and some having lateral doors or alignment apertures. In some cases, a supply of particulate materials is stored in a separate container above the turning mechanism, making the devices much more complex.

In some cases, the filling process itself can tend to cause excessive spilling of the particulate composition.

There is a long-standing need for an improved applicator for spreading particulate carpet-cleaning compositions. More specifically, there is a need for an improved applicator providing reliable control of the dispensing rate for non-free flowing particulate carpet-cleaning compositions which is simplified in structure and operation, which serves both as a containment vehicle and as a substantially air-tight dispenser, and which allows quick and easy filling without losing control of the particulate composition.

OBJECTS OF THE INVENTION

It is an object of this invention to provide an improved applicator for particulate compositions.

Another object to provide an improved applicator for crumbly, liquid-impregnated particulate compositions for dry carpet cleaning overcoming some of the problems and shortcomings of the prior art.

Another object of this invention is to provide an improved applicator useful with non-free flowing particulate compositions such as are used in dry extraction carpet cleaning.

Another object of this invention is to provide an improved applicator for such compositions which prevents significant loss of the volatile content of such compositions during extended periods of storage within the applicator.

Another object of this invention is to provide an improved applicator for such compositions which is easily adjustable.

Another object of this invention is to provide an improved applicator for such compositions which while being substantially vapor-tight is still easily adjustable for dispensing at a particular rate or for closing.

Another object of this invention is to provide an improved applicator for such compositions which dispenses with reliable control regardless of whether the apertured dispensing container is nearly full or nearly empty.

Another object is to make cost estimating for carpet cleaning jobs more accurate.

Another object of this invention is to provide an improved applicator for particulate carpet-cleaning compositions which is easily opened for fast filling and which allows filling without spillage.

Another object is to provide an improved applicator having the above qualities which is simple in construction and simple to understand and use.

These and other important objects will be apparent from the descriptions which follow.

SUMMARY OF THE INVENTION

This invention is an improved applicator for particulate carpet-cleaning compositions overcoming certain problems of the prior art. The applicator of this invention is of the type having floor-engaging wheels on either side of an apertured dispensing container which dispenses the composition while rotating as the applicator is pushed across the floor. It allows controlled application of such particulate compositions.

The dispensing container has a cylindrical body formed of relatively rotatable inner and outer concentric cylindrical members having tightly contacting outside and inside surfaces, respectively, of about equal diameter. The inner and outer cylindrical members are in 360° C. frictional nested engagement, such that properly adjusted they provide, along with appropriate end members, a substantially vapor-tight enclosure.

Dispensing apertures which are in one of the cylindrical members may be tightly closed by the contact of the other cylindrical member, depending on their relative positions. First and second wheel members are non-rotatably secured to the inner and outer members, respectively, at opposite ends of the cylindrical body. The wheel members are of diameter greater than the diameter of the cylindrical body.

While remaining in tight surface-to-surface frictional engagement, the cylindrical members in this invention are easily rotated with respect to each other by opposed manual rotation of the wheels, moving the cylindrical members into a selected dispensing position or to a substantially vapor-tight closed position. The frictional engagement of the cylindrical members of this invention minimizes any loss of volatiles during extended storage of the composition in the container. Storage in the applicator overnight or for several days becomes possible. The wheel-cylinder configuration of this invention allows easy rotational adjustment even with such tight frictional engagement.

In certain embodiments, a pivot member is concentrically secured on the outer surface of each wheel in position for attachment to a mounting bracket which is used for attachment of an applicator push handle. In this pivot mounting arrangement, the dispensing container encloses an axle-free void space for containment of the carpet-cleaning composition to be dispensed. The pivot means preferably includes a spindle and the mounting bracket has spindle-engaging ends.

In some preferred embodiments, the first wheel is secured to one end of the inner cylindrical member and a circular end member is secured to the other end of the inner cylindrical member in position immediately adjacent to the second wheel. Such end member supports the cylindrical shape of the inner member and helps assure the 360° frictional engagement along the length of the cylindrical body.

A pocket is preferably formed on the periphery of such end member and a stop member is secured within the pocket, thus securing it with respect to the inner cylindrical member. A plurality of openings are in the outer cylindrical member each positioned to receive the stop member, such that the cylindrical members may be held in predetermined relative rotational positions. The stop member is preferably a spring-loaded button which is biased toward the outer cylindrical member such that it snaps through one of the openings to hold the cylindrical members in selected relative rotational position. Depression of the button by the thumb of the user allows disengagement of the button from the outer cylindrical opening and relative rotation of the inner and outer cylinder. Depression of the button can be accomplished by the thumb of a hand gripping one of the wheels.

The end member, attached to the inner cylindrical member is preferably rotatably secured to the pivot member by an axially located connecting member extending through the end member. This helps secure the inner and outer cylindrical members in fixed relative axial positions.

In highly preferred embodiments, the inner and outer cylindrical members form inner and outer major filling openings, respectively, spanning all or nearly all of the width of the cylinders. Such two filling openings, each of which is substantially larger than the dispensing apertures, are alignable by relative rotation of the cylindrical members for easy and convenient filling of the container, eliminating any need for disassembly or cover removal. When such openings are aligned for filling, all dispensing apertures are closed. This fact and the large size of such filling openings allow filling without spillage of particulates.

Certain highly preferred embodiments have a specific form of non-rotatable attachment of each wheel member to one of the cylindrical members. Such wheel members each have a concentric axially extending protuberance which forms an annular edge the diameter of which is less than the diameter of the cylindrical body. The cylindrical member attached to such wheel member has a circular wheel-engaging free edge which is secured to the annular edge formed by the protuberance.

In such arrangements, each wheel member serves as a wheel, as means to maintain the cylindrical shape of the cylindrical member, and also as means to enclose the space within the cylindrical body.

The dispensing container of this invention has an arrangement of dispensing apertures which provides accurate control of dispensing of the crumbly particulates used for carpet cleaning. The outer cylindrical member has a first array of dispensing apertures which are closed or open depending on the relative rotational position of the inner cylindrical member with respect thereto.

The inner cylindrical member preferably has a second array of dispensing apertures formed on it and movable with it for such selective closing of the dispensing apertures on the outer cylindrical member. The second array preferably includes a plurality of subsets of arrays selectively alignable with the first array by movement of the inner cylindrical member to set different dispensing rates. The inner cylindrical member also has, adjacent to one of the subsets, a closing area which when aligned with the first array closes all first array apertures in the outer cylindrical member.

The second array subsets preferably include a high-rate subset which when aligned with the first array leaves all first array apertures wide open and at least one reduced-rate subset which when aligned with the first array closes some of the first array apertures while leaving others wide open. The high-rate subset provides a relatively heavy application of carpet-cleaning composition while lighter applications are provided by the other subset.

Having the dispensing apertures either wide-open or completely closed and varying the dispensing rate by varying the number of wide-open dispensing apertures, as described above, allows predictable dispensing characteristics for non-free flowing particulate compositions such as are frequently used in carpet cleaning.

Such compositions, generally described above, are dispensed predictably and at acceptably constant rates throughout the dispensing cycle, that is, when the dispensing container is full, half full, and near empty. Little or no "bridging," as previously described, occurs. The dispensing predictability is such that a carpet cleaner can properly estimate the amount of composition required for a carpet-cleaning job and thus properly estimate his cost.

In preferred embodiments, the first array apertures, in the outer cylindrical member, are aligned in a row parallel to the axis of the outer cylindrical member. Likewise, the apertures of each of the subsets of the second array of apertures are aligned in a row parallel to such axis. However, the subsets of the second array have differing arrangements from each other in that they have different numbers of apertures with blocking areas in-between.

The aforementioned stop member and plurality of stop openings which hold the outer and inner cylindrical members in predetermined relative positions allow selective alignment of one of the subsets of aperture arrays, or the closing area, with the first array of apertures.

BRIEF DESCRIPTION OF THE DRAWINGS

FIG. 1 is a perspective view of the applicator of this invention.

FIG. 2 is an enlarged fragmentary front elevation.

FIG. 3 is a further enlarged sectional detailed view taken along section 3—3 as indicated in FIG. 2.

DETAILED DESCRIPTIONS OF PREFERRED EMBODIMENTS

Figure 4:
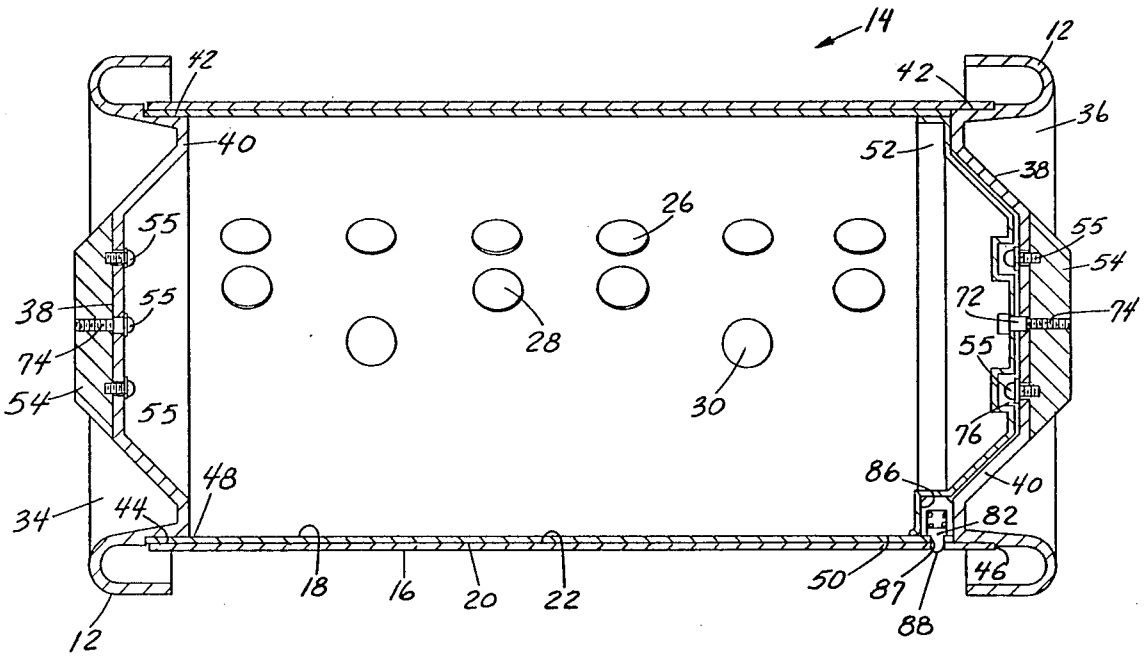
FIG. 4 is an enlarged axial sectional view of the dispensing container element of the applicator shown in FIG. 1.
Figure 5:
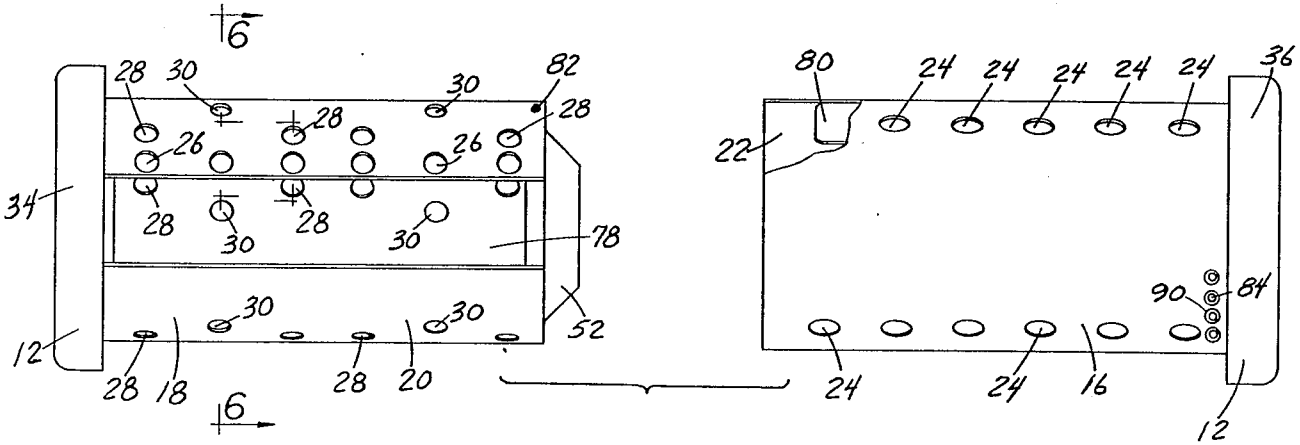
FIG. 5 is a reduced partially exploded elevation of FIG. 4, showing the principal cylindrical members unnested with their wheel members attached.
Figure 6:
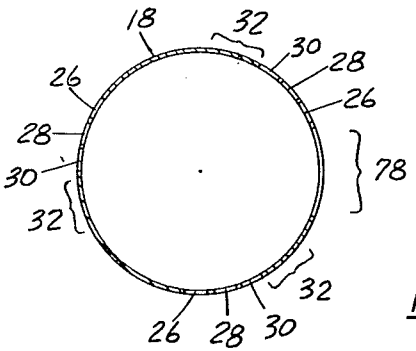
FIG. 6 is a sectional view without background taken along section 6—6 as indicated in FIG. 5.

The drawings illustrate an applicator 10 for a particulate carpet-cleaning composition in accordance with a preferred embodiment of this invention. Applicator 10 is of the type with floor-engaging wheels 12 on either side of an apertured dispensing container 14 which dispenses the carpet-cleaning composition onto the carpet as it rotates, primarily by the force of gravity.

Container 14 is a hollow cylindrical body formed of a first (or outer) cylindrical member 16 and a second (or inner) cylindrical member 18. Inner cylindrical member 18 has an outside surface 20 and outer cylindrical member 16 has an inside surface 22. The diameters of outside and inside surfaces 20 and 22 are equal or essentially equal such that outer and inner cylindrical members 16 and 18 are in 360° frictional nested engagement.

Outer and inner cylindrical members 16 and 18, while frictionally engaged, are relatively rotatable about their common axis when sufficient relative rotational force is applied. However, their frictional engagement is such that their relative rotational positions will not change unless substantial rotational force is intentionally applied.

Outer cylindrical member 16 has three identical arrays of dispensing apertures 24, sometimes each referred to herein as a first array. Such first arrays are spaced circumferentially about outer cylindrical member 16. Each first array consists of six dispensing apertures 24 aligned in a row which is parallel to the axis of the cylindrical body and extends along its length.

All particulate carpet-cleaning composition dispensed by applicator 10 will pass through apertures 24. However, inner cylindrical member 18, which is adjacent to outer cylindrical member 16, serves as a control means to selectively close some of the first dispensing apertures while leaving others wide open, as hereafter described.

For each first array of dispensing apertures 24 in outer cylindrical member 16, inner cylindrical member 18 has a second array of twelve dispensing apertures 26, 28 and 30. Thus, there are three identical second arrays of apertures circumferentially spaced about inner cylindrical member 18. Dispensing apertures 26, 28 and 30 are movable by rotation of inner cylindrical member 18 for selective closing of first dispensing apertures 24. Each second array reacts with its counterpart first array at the same time and in an identical manner as cylindrical members 16 and 18 are rotated relative to each other.

Each such second array of dispensing apertures 26, 28 and 30 consists of three subsets of arrays, that is, dispensing apertures 26, dispensing apertures 28 and dispensing apertures 30. The apertures of each such subset are aligned in a row parallel to the axis of the cylindrical body.

For each second array of apertures, apertures 26 form a high-rate subset which when aligned with apertures 24 of outer cylindrical member 16 will provide a relatively heavy application of particulate carpet-cleaning composition on the carpet. Each high-rate subset is congruent with each first array of apertures 24 in outer cylindrical member 16, such that when aligned therewith all first array apertures 24 are wide open.

For each second array of apertures, dispensing apertures 28 form a reduced-rate subset which when aligned with the first array of dispensing apertures 24 leaves four dispensing apertures 24 wide open and closes (covers) the two other dispensing apertures 24. When such reduced-rate subset is aligned with dispensing apertures 24, a moderate application of composition results. Likewise, dispensing apertures 30 form a further reduced-rate subset which when aligned with the first array of dispensing apertures 24 leaves two of apertures 24 wide open while covering the remaining four. This provides a light application of carpet-cleaning composition.

Thus, by adjusting the relative rotational positions of outer and inner cylindrical members 16 and 18, three different dispensing rates may be set. In each case, each of the apertures 24 is either wide open or completely closed.

In addition to the three subsets of apertures in each second array, inner cylindrical member 18 has a closing area 32 adjacent to the subset of dispensing apertures 30. Inner cylindrical member 18 may be rotated relative to outer member 16 such that the three closing areas 32, one adjacent to each second array, are aligned with the three first arrays of dispensing apertures 24 in outer cylindrical member 16 to close all the dispensing apertures 24 in outer member 16.

There are a pair of wheels 12, namely, first and second wheel members 34 and 36. Wheel members 34 and 36 each have an outer surface 38 which has a concentric axially-extending annular protuberance 40 forming an annular edge 42. Annular edges 42, used for attachment to outer and inner cylindrical members 16 and 18, have a diameter less than the diameter of outer cylindrical member 16.

Inner cylindrical member 18 has a circular wheel-engaging free edge 44 while outer cylindrical member 16 has a similar free edge 46. Free edge 44 is non-rotatably secured, by an adhesive or otherwise, to annular edge 42 of first wheel member 34. Free edge 46 is non-rotatably secured in similar manner to annular edge 42 of second wheel member 36. Thus, first and second wheel members 34 and 36 are non-rotatably secured with respect to inner and outer cylindrical members 18 and 16, respectively, at opposite ends of the cylindrical body formed by cylindrical members 16 and 18.

This arrangement allows outer and inner cylindrical members 16 and 18 to be relatively rotatable very easily by grasping first and second wheel members 34 and 36, one in each hand, and rotating them manually in opposite directions. This configuration provides excellent leverage for relative rotation of cylindrical members 16 and 18 even though the frictional engagement of cylindrical members 16 and 18 is substantial.

The frictional engagement of cylindrical members 16 and 18, and the sealing of the ends of cylindrical members 16 and 18 by wheel members 34 and 36, provides a substantially vapor-tight condition when container 14 is closed. This minimizes any loss of volatiles from a particulate carpet-cleaning composition inside the container.

Such substantially vapor-tight condition maintains the composition against significant loss of volatiles even during storage of the composition in container 14 over extended periods. Yet, the above described arrangement of first and second wheel members 34 and 36 with inner and outer cylindrical members 16 and 18 allows easy adjustment by relative rotation.

The engagement of first and second wheel members 34 and 36 with inner and outer cylindrical members 18 and 16 also serves to maintain the cylindrical shape of cylindrical members 16 and 18. In the case of inner cylindrical member 18, first wheel member 34 is attached at a first end 48. At the opposite (or second) end 50, a circular end member 52, having an outer diameter matching the inner diameter of inner cylindrical member 18, is secured by adhesive or otherwise.

End member 52 is secured to inner cylindrical member 18 in an axial position immediately adjacent to second wheel member 36. End member 52 helps to make container 14 substantially vapor-tight. It also serves to support the cylindrical shape of inner cylindrical member 18, thereby enhancing the 360° frictional engagement of cylindrical members 16 and 18 along their lengths.

Outer surfaces 38 of wheel members 34 and 36 each have a solid pivot member 54 concentrically secured thereto by screws 55 which extend through the wheel members. Pivot members 54 facilitate attachment of a yoke or mounting bracket 56 with respect to which container 14 will rotate as applicator 10 is pushed across a carpet.

Each pivot member 54 includes an axially extending spindle 58 non-rotatably secured thereto by a screw 60, as illustrated in FIG. 3, which is set in central threaded bores 74 extending through pivot members 54. Mounting bracket 56 includes a pair of legs 62 each of which define a spindle-receiving opening 64. A pair of washers 66 and a bearing member 67 facilitate the rotational relationship of bracket legs 62 with spindle 58.

This means of rotatable mounting of container 14 with respect to mounting bracket 56 eliminates the need for an axle or other axial structure extending through container 14. Thus, container 14 encloses an axle-free void space for containment of a particulate carpet-cleaning composition.

Mounting bracket 56 also includes a cross member 68 to which an upright handle member 70 is attached. Applicator 10 is used for applying a particulate carpet-cleaning composition by grasping handle member 70 and pushing applicator 10 across the carpet. During such pushing, container 14 rotates about the axis defined by spindles 58 and composition within container 14 is dispensed through dispensing apertures 24.

Also attached to cross member 68 of mounting bracket 56 is a hood 71. Hood 71 serves to shield much of container 14 from view and also provides a handy surface for application of instructional information and the like.

Outer and inner cylindrical members 16 and 18 are maintained in the proper relative axial positions by rotatable attachment of end member 52, previously described, to the pivot member 54 which is attached to second wheel member 36. Such attachment is by means of an axially-located shoulder bolt 72 which extends into the aforementioned central threaded bore 74 in such pivot member 54. Shoulder bolt 72 extends into bore 74 in a direction opposite that of screw 60 used for mounting of spindles 58 to such pivot members 54. End member 52 has a concentric annular void 76 formed on it the purpose of which is to avoid interference with screws 55 during the relative rotation of end member 52 and adjacent second wheel member 36.

In addition to dispensing apertures 24, 26, 28 and 30, inner and outer cylindrical members 18 and 16 form large inner and outer filling openings 78 and 80, respectively. Inner and outer filling openings 78 and 80 are alignable by relative rotation of cylindrical members 16 and 18 and, when aligned, allow easy filling of container 14 with a particulate carpet-cleaning composition.

Filling openings 78 and 80 and dispensing apertures 24, 26, 28 and 30 are arranged on cylindrical members 16 and 18 such that when filling openings 78 and 80 are aligned for filling, all dispensing apertures 24 are covered. That is, closing areas 32 of inner cylindrical member 18 cover dispensing apertures 24 in outer cylindrical member 16 during filling.

Proper alignment of dispensing apertures 26, 28 and 30 and closing area 32 with dispensing apertures 24 is facilitated by a spring-loaded button 82 which cooperates with a plurality of button-receiving openings 84. Button 82 and openings 84 serve as means to stop inner cylindrical member 18, after relative rotation with respect to outer cylindrical member 16, at a selected proper position of rotational alignment. In such proper positions of rotational alignment, each dispensing aperture 24 in outer cylindrical member 16 is either wide open or completely closed.

More specifically, spring-loaded button 82, as illustrated in FIG. 4, is secured in a pocket 86 formed in the periphery of end member 52. In this way, spring-loaded button 82 is secured with respect to inner cylindrical member 18. Button 82 has a rounded distal end 88 which is spring biased such that it extends through a hole 87 in inner cylindrical member 18. The spring biasing of button 82 is such that, depending on the relative rotational positions of outer and inner cylindrical members 16 and 18, it either bears against inside surface 22 of outer cylindrical member 16 and or extends through one of the openings 84 in outer cylindrical member 16.

The positioning of openings 84 in outer cylindrical member 16 is such that when button 82 engages each one of them, outer and inner cylindrical members 16 and 18 are in one of the proper positions of selective alignment.

Rounded distal end 88 may be depressed easily by finger contact to disengage button 82 from an opening 84. Such disengagement is facilitated by bevelings 90 in outer cylindrical member 16 around each of the openings 84. Furthermore, button 82 and openings 84 are located immediately adjacent to second wheel member 36 such that button 82 may be depressed by the thumb of one hand of the operator hand as it grasps second wheel member 36. This is particularly convenient since the operator's other hand is usually engaged grasping first wheel member 34 for the relative rotational adjustment of cylindrical members 16 and 18 as earlier described.

Cylindrical members 16 and 18, wheel members 34 and 36, end member 52, and hood 71 are preferably made of plastics having high impact strength and rigidity. A preferred material for wheel members 34 and 36 and end member 52 is acrylonitrile butadiene styrene, such as ROYALITE from Uniroyal, Middlebury, Conn. Wheel members 34 and 36, end member 52, and hood 71 are preferably vacuum formed to their desired shapes.

The cylindrical members are preferably made of polyvinyl chloride. The cylindrical members, wheel members and end member are of sufficient thickness to provide required rigidity and structural stability. Hood 71 need not be as thick and sturdy.

Pivot members 54, spindles 58, mounting bracket 56, and handle member 70 are preferably made of metal. Pivot members 54 are relatively thick metal pieces. Many other materials are acceptable. Appropriate materials would be apparent to those skilled in the art who are familiar with this invention.

While the principles of this invention have been described in connection with specific embodiments, it should be understood clearly that these descriptions are made only by way of example and are not intended to limit the scope of the invention.

We claim:

1. In an applicator for particulate carpet-cleaning compositions of the type with floor-engaging wheels on the ends of an apertured container for rotational dispensing, the improvement wherein the container comprises:

a cylindrical body formed of relatively rotatable inner and outer cylindrical members having outside and inside surfaces, respectively, of about equal diameter in 360° frictional nested engagement;

dispensing apertures in one of the cylindrical members which may be closed by the other cylindrical member, depending on its relative rotational position;

outer and inner filling openings in the outer and inner cylinders, respectively, such openings substantially larger than the dispensing apertures and alignable by relative rotation of the cylindrical members for convenient filling, the dispensing apertures arranged to be closed when the filling openings are aligned;

first and second wheel members non-rotatably secured to the inner and outer cylindrical members, respectively, at opposite ends of the cylindrical body, the wheel members of diameter greater than that of the cylindrical body, whereby by opposed manual rotation of the wheels the cylindrical members are relatively rotatable easily to a filling position, a dispensing position, and a substantially vapor-tight closed position minimizing loss of volatiles during extended storage of the composition in the container.

2. The applicator of claim 1 further comprising:

each wheel having an outer surface; and a pivot means concentrically secured to each outer surface for attachment to a mounting bracket, whereby the dispensing container encloses an axle-free void space for the composition to be dispensed.

3. The applicator of claim 1 wherein the inner cylindrical member has first and second ends, the first wheel being secured at the first end, and further comprising an end member secured to the inner cylindrical member at the second end in position immediately adjacent to the second wheel, thereby supporting the cylindrical shape of the inner cylindrical member and 360° frictional engagement along the length of the cylindrical body.

4. The applicator of claim 3 further including:

a pocket formed on the periphery of the end member;

a stop member within the pocket, thereby securing it with respect to the inner cylindrical member;

a plurality of openings in the outer cylindrical member each positioned to receive the stop member, whereby the cylindrical members may be held in predetermined relative rotational positions.

5. The applicator of claim 1 wherein the non-rotatable securement of each wheel member to one of the cylindrical members comprises:

each wheel member having a concentric axially extending protuberance forming an annular edge, the annular edge having a diameter less than that of the cylindrical body; and the cylindrical member having a circular wheel-engaging free edge secured to the annular edge, whereby the wheel member serves as a wheel, as means to maintain the cylindrical shape of the cylindrical member, and as means to enclose the space within the cylindrical body.

6. The applicator of claim 1 comprising:

the dispensing apertures including a first array of apertures in the outer cylindrical member and a second array of apertures in the inner cylindrical member;

the second array including a plurality of subsets of arrays selectively alignable with the first array by rotation of the inner cylindrical member to set different dispensing rates by selectively closing some of the first dispensing apertures while leaving others wide open;

the inner cylindrical member having, adjacent to one of the subsets, a closing area which when aligned with the first array closes all first array apertures;

a stop member secured with respect to one of the cylindrical members and spring-biased in a radial direction against the other cylindrical member; and a plurality of stop openings in the other cylindrical member each positioned to receive the stop member when the inner cylindrical member is in one of the positions of selective alignment, whereby reliable control of dispensing is provided for a non-free flowing particulate carpet-cleaning composition.

7. The applicator of claim 6 wherein the stop member is a spring-loaded button having a distal end movable between a retracted position against said other cylindrical member and an extended position protruding through one of the stop openings to lock the cylindrical members together against relative movement.

8. The applicator of claim 7 wherein the one cylindrical member is the inner cylindrical member and the other cylindrical member is the outer cylindrical member.

9. The applicator of claim 8 wherein the stop member is a spring-loaded button having a distal end movable between a retracted position against said other cylindrical member and an extended position protruding through one of the stop openings to lock the cylindrical members together against relative movement.

10. In an applicator for a particulate carpet-cleaning composition of the type having floor-engaging wheels on either side of an apertured dispensing container which dispenses the composition upon rotation thereof, the improvement wherein the container comprises:

a cylindrical body formed of relatively rotatable inner and outer concentric cylindrical members having outside and inside surfaces, respectively, of about equal diameter such that they are in 360° frictional nested engagement;

dispensing apertures in at least one of the cylindrical members which may be closed by the other cylindrical member, depending on its relative rotational position;

first and second wheel members non-rotatably secured with respect to the inner and outer cylindrical members, respectively, at opposite ends of the cylindrical body, the wheel members of diameter greater than that of the cylindrical body, the inner cylindrical member having first and second ends, the first wheel being secured at the first end;

an end member secured to the inner cylindrical member at the second end in position immediately adjacent to the second wheel to support the cylindrical shape of the inner member and the 360 frictional engagement along the length of the cylindrical body;

a pocket formed on the periphery of the end member;

a stop member within the pocket, thereby securing it with respect to the inner cylindrical member; and a plurality of openings in the outer cylindrical member each positioned to receive the stop member such that the cylindrical members may be held in predetermined relative rotational positions, whereby the cylindrical members are relatively rotatable easily by opposed manual rotation of the wheels to a dispensing position or a substantially vapor-tight closed position minimizing loss of volatiles during extended storage of the composition inside the container.

11. The applicator of claim 10 wherein the non-rotatable securement of each wheel member to one of the cylindrical members comprises:

each wheel member having a concentric axially extending protuberance forming an annular edge, the annular edge having a diameter less than that of the cylindrical body; and the cylindrical member having a circular wheel-engaging free edge secured to the annular edge, whereby the wheel member serves as a wheel, as means to maintain the cylindrical shape of the cylindrical member, and as means to enclose the space within the cylindrical body.

12. The applicator of claim 11 wherein the inner and outer cylindrical members form inner and outer filling openings, respectively, alignable by relative rotation of the cylindrical members for convenient filling of the container.

13. The applicator of claim 12 further comprising:

each wheel having an outer surface; and a pivot means concentrically secured to each outer surface for attachment to a mounting bracket, whereby the dispensing container encloses an axle-free void space for the composition to be dispensed.

14. The applicator of claim 13 further comprising:

each pivot means comprising a spindle;

the mounting bracket having spindle-engaging ends.

15. The applicator of claim 14 wherein the end member is rotatably secured to the pivot member by an axially located connecting member extending through the end member, thereby securing the inner and outer cylindrical members in fixed relative axial positions.

* * * * *

UNITED STATES PATENT AND TRADEMARK OFFICE

CERTIFICATE OF CORRECTION

PATENT NO. : 4,863,069

DATED : September 5, 1989

INVENTOR(S) : William F. Glaeser et al.

It is certified that error appears in the above-identified patent and that said Letters Patent is hereby corrected as shown below:

On the title page, the title should be --APPLICATOR FOR DISPENSING AND STORING OF PARTICULATE CARPET-CLEANING COMPOSITION--.

On the title page, the following changes must be made in the "Inventors" section:

In line 2, change "Grant D" to --Grant D.--;
In line 6, change "Hialead" to --Hialeah--;
In line 7, change "Goeffrey" to --Geoffrey--; and
In line 9, change "53402" to 53403--.

On the title page, the Assignee should be listed as follows: --Racine Industries, Inc., Racine, Wisconsin--.

In the Abstract, line 9, change "be" to --by--.

In column 3, line 3, after "object" insert --is--.

In column 3, line 65, after "of" insert --a--.

UNITED STATES PATENT AND TRADEMARK OFFICE

CERTIFICATE OF CORRECTION

PATENT NO. : 4,863,069

DATED : September 5, 1989

INVENTOR(S) : William F. Glaeser et al.

It is certified that error appears in the above-identified patent and that said Letters Patent is hereby corrected as shown below:

In column 12, line 20 (claim 10), change "360" to --360°--.

Signed and Sealed this

Sixteenth Day of October, 1990

*Attest:*

HARRY F. MANBECK, JR.

*Attesting Officer*

*Commissioner of Patents and Trademarks*